US011407571B2

(12) United States Patent
Taglini

(10) Patent No.: US 11,407,571 B2
(45) Date of Patent: Aug. 9, 2022

(54) CORNER-BREAK-OPEN SEALED PACKAGE

(71) Applicant: Easysnap Technology S.r.l., Modena (IT)

(72) Inventor: Andrea Taglini, Modena (IT)

(73) Assignee: Easysnap Technology S.R.L., Modena (IT)

( * ) Notice: Subject to any disclaimer, the term of this patent is extended or adjusted under 35 U.S.C. 154(b) by 46 days.

(21) Appl. No.: 16/977,978

(22) PCT Filed: Mar. 7, 2019

(86) PCT No.: PCT/IB2019/051855
§ 371 (c)(1),
(2) Date: Sep. 3, 2020

(87) PCT Pub. No.: WO2019/171322
PCT Pub. Date: Sep. 12, 2019

(65) Prior Publication Data

US 2021/0053736 A1 Feb. 25, 2021

(30) Foreign Application Priority Data

Mar. 7, 2018 (IT) ..... 102018000003352

(51) Int. Cl.
*B65D 75/58* (2006.01)
*B65D 75/30* (2006.01)

(52) U.S. Cl.
CPC ..... *B65D 75/585* (2013.01); *B65D 75/30* (2013.01); *B65D 2221/00* (2013.01)

(58) Field of Classification Search
CPC .. B65D 75/5816; B65D 75/366; B65D 75/30; B65D 2575/3227; B65D 2575/366; B65D 2221/00; B65D 2075/363
See application file for complete search history.

(56) References Cited

U.S. PATENT DOCUMENTS 2,125,318 A 8/1938 Salfisberg
6,663,019 B2 * 12/2003 Garcia ..... A45D 37/00 222/630

(Continued)

FOREIGN PATENT DOCUMENTS

CN 1079705 A 12/1993
CN 1636834 A 7/2005

(Continued)

OTHER PUBLICATIONS

PCT International Search Report and Written Opinion dated May 10, 2019 for PCT/IB2019/051855.

(Continued)

*Primary Examiner* — Mollie Impink

(74) *Attorney, Agent, or Firm* — McCarter & English, LLP

(57) ABSTRACT

A break-open sealed package is disclosed; the sealed package includes: a first sheet of semi-rigid plastic material; a sealed pocket, which contains a dose of a product and is delimited on one side by the first sheet; and a pre-weakened area, which guides, following a folding of the first sheet, a controlled break of the first sheet in the pre-weakened area to form an outlet opening for the product through the first sheet. The pre-weakened area is arranged at one end of the first sheet and extends from a first outer edge of the first sheet to a second outer edge of the first sheet to divide the first sheet into a holding portion and into a folding portion that is smaller than the holding portion.

15 Claims, 10 Drawing Sheets

(56) References Cited

U.S. PATENT DOCUMENTS

| | | | | |
|---|---|---|---|---|
| 7,506,762 | B2 * | 3/2009 | Nelson | B65B 61/02 206/229 |
| 8,028,837 | B2 * | 10/2011 | Gerstle | B65D 75/585 206/494 |
| 2011/0100859 | A1 * | 5/2011 | Burattini | B31F 1/08 206/524.6 |
| 2011/0262589 | A1 * | 10/2011 | Safarik | B32B 7/05 426/5 |

FOREIGN PATENT DOCUMENTS

| | | | |
|---|---|---|---|
| CN | 101568477 | A | 10/2009 |
| CN | 106470916 | A | 3/2017 |
| EP | 2628691 | A1 | 8/2013 |
| EP | 2628691 | A1 | 8/2013 |
| WO | WO 2008/038074 | A2 | 4/2008 |
| WO | WO 2009/040629 | A2 | 4/2009 |

OTHER PUBLICATIONS

English Translation of Chinese First Office Action dated Jan. 29, 2022.

* cited by examiner

CORNER-BREAK-OPEN SEALED PACKAGE

CROSS-REFERENCE TO RELATED APPLICATIONS

This patent application is a 35 U.S.C. § 371 National Stage filing of International Application No. PCT/IB2019/051855 filed on Mar. 7, 2019, which application claims priority from Italian Patent Application No. 102018000003352 filed on Mar. 7, 2018, the disclosure of which is incorporated herein by reference.

TECHNICAL FIELD

The present invention relates to a corner-break-open sealed package.

PRIOR ART

Patent applications WO2008038074A2, WO2009040629A2 and EP2628691A1 describe a single-dose corner-break-open sealed package; the sealed package comprises a sheet of semi-rigid plastic material and a sheet of flexible plastic material, which is superimposed and welded to the sheet of semi-rigid plastic material to define a sealed pocket containing a dose of a fluid product. The sheet of semi-rigid plastic material centrally has a pre-weakened area, which guides a controlled break of the sheet of semi-rigid plastic material to form an outlet opening for the product through the sheet of semi-rigid plastic material. In other words, in use, to open the sealed package, a user must grasp the sealed package with the fingers of one hand and "V"-fold the sealed package until breaking the sheet of semi-rigid plastic material in the pre-weakened area. The pre-weakened area comprises an inner incision, which is formed through an inner surface (i.e. facing the pocket) of the sheet of semi-rigid plastic material and an outer incision, which is formed through an outer surface of the sheet of semi-rigid plastic material and is aligned with inner incision.

The single-dose sealed package described in patent applications WO2008038074A2, WO2009040629A2 and EP2628691A1 is particularly designed to dose liquid (e.g. a food sauce such as ketchup or a liquid detergent) or creamy products (e.g. a food sauce such as mayonnaise or a body cream). However, the single-dose sealed package described in patent applications WO2008038074A2, WO2009040629A2 and EP2628691A1 is not (particularly) designed to dose powdered products (e.g. powdered condiments such as fine salt or ground pepper or sugar) or granulated products (e.g. pepper in grains), since the passage section formed through the controlled break of the sheet of semi-rigid plastic material is not sufficiently extended to allow an easy and complete release of a powdered or granulated product.

The Italian patent application 102017000002440 discloses a single-dose sealed package designed to dose powdered or granulated products since the passage section through the controlled break of the sheet of semi-rigid plastic material is adequately extended to allow an easy and complete release of a powdered or granulated product. This result is obtained thanks to the fact that the two incisions (inner incision and outer incision) extend along at least two intersecting incision lines. However, even the single-dose sealed package described in the Italian patent application 102017000002440 does not always allow a complete release of the powdered or granulated product contained within the package. In fact, in some cases a (small) part of the powdered or granulated product remains "trapped" inside the package and therefore the folding of the package must be repeated several times to obtain the complete release of the powdered or granulated product.

U.S. Pat. No. 2,125,318A describes a single-dose sealed package for powders, in which a corner is torn away to open the package. In particular, the package includes two side-by-side twin envelopes containing different powdered products that are dispensed together and then mixed by tearing at the same time the opening angle of both envelopes.

DESCRIPTION OF THE INVENTION

The object of the present invention is to provide a corner-break-open sealed package, wherein the package is free from the drawbacks described above and is, in particular, easy and inexpensive to implement.

According to the present invention, a single-dose sealed package is provided with a break-open, as defined in the appended claims.

The claims describe preferred embodiments of the present invention forming an integral part of the present description.

BRIEF DESCRIPTION OF THE DRAWINGS

The present invention will now be described with reference to the annexed drawings showing a non-limiting embodiment, in which.

PREFERRED EMBODIMENTS OF THE INVENTION

Figure 2:
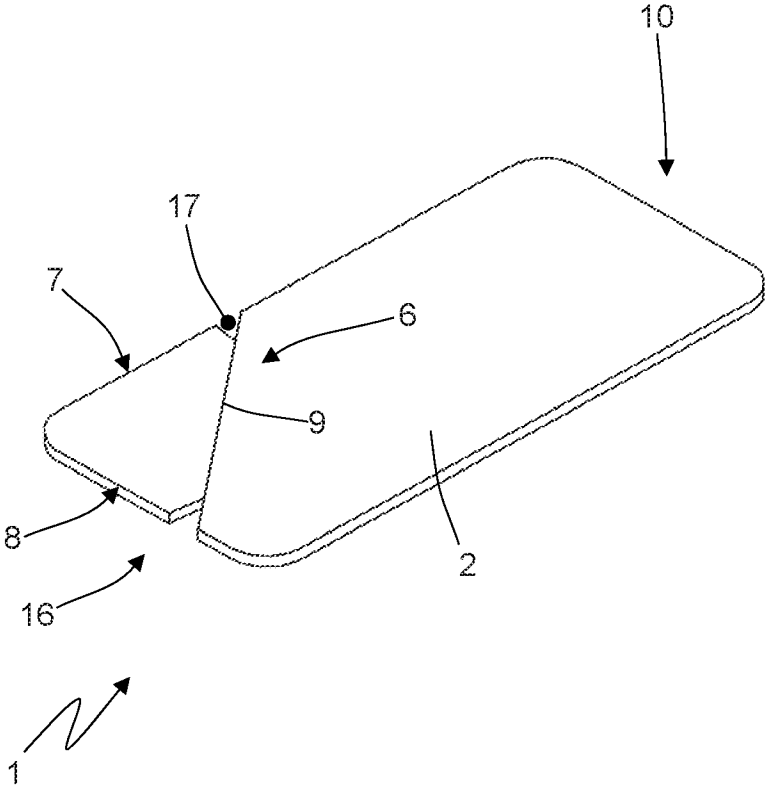
FIG. 2 is a perspective bottom view of the sealed package of FIG. 1.
Figure 1:
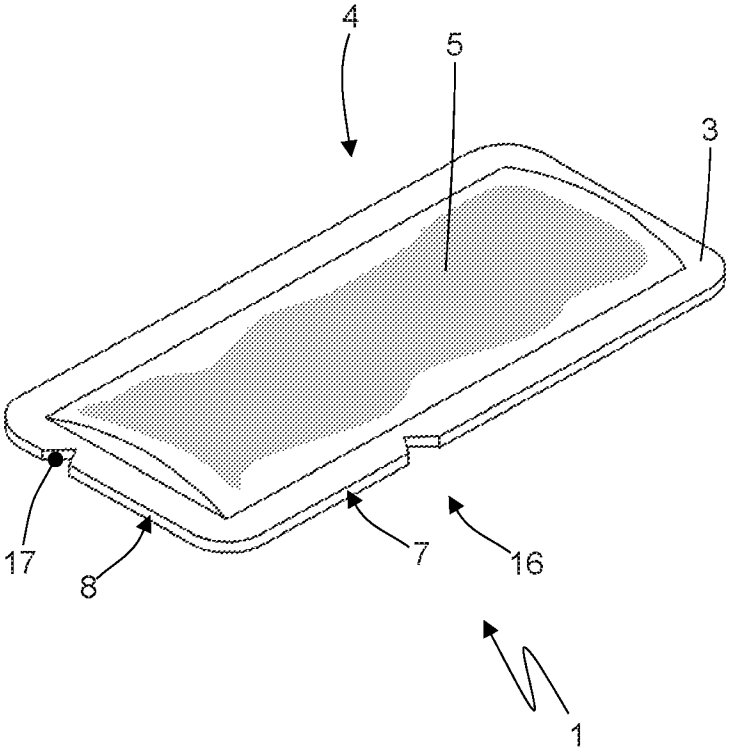
FIG. 1 is a perspective view from above of a break-open sealed package made according to the present invention.
Figure 3:
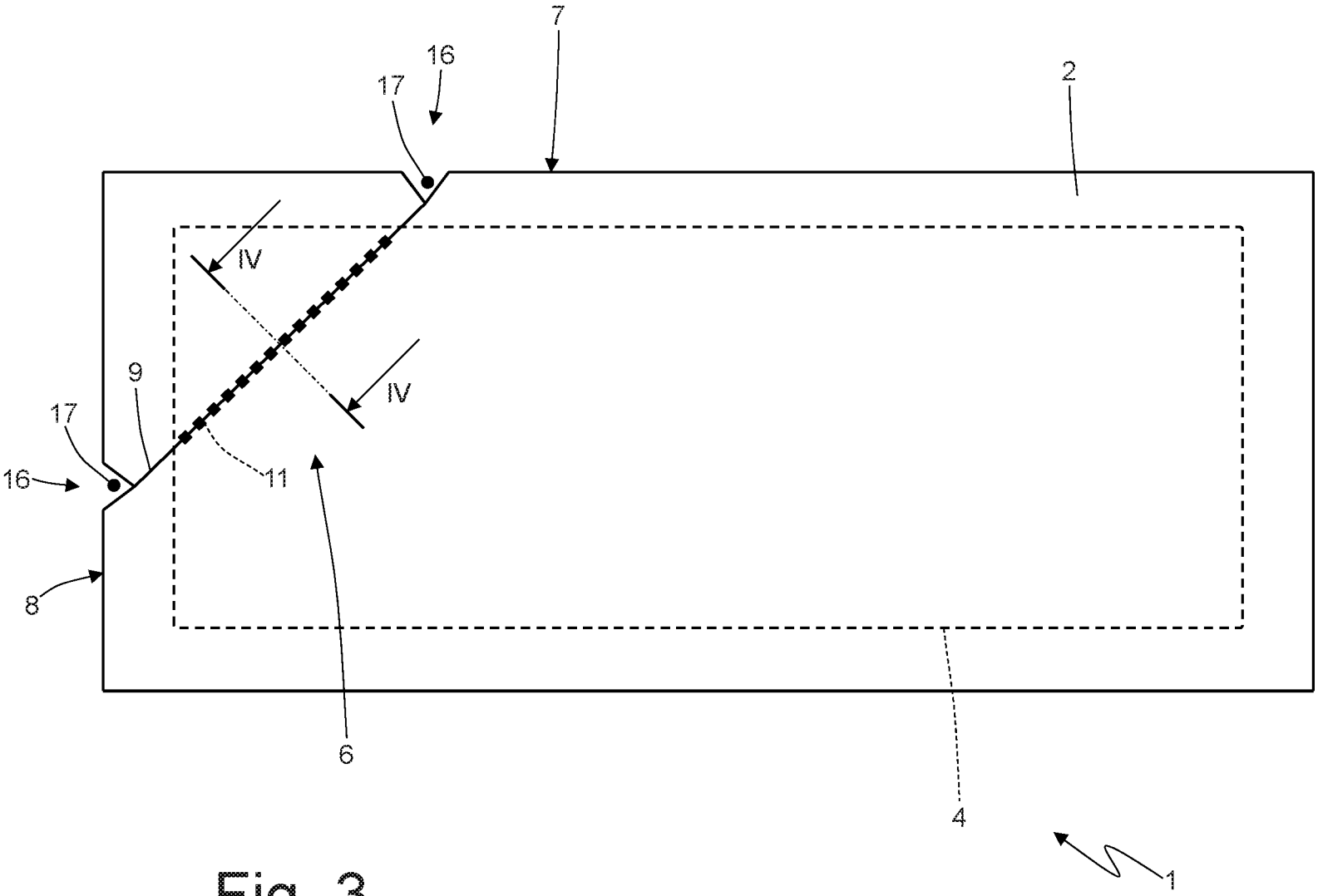
FIG. 3 is a bottom view of the sealed package of FIG. 1.

In FIGS. 1, 2 and 3, the number 1 indicates as a whole a break-open single-dose sealed package. The single-dose sealed package 1 comprises a sheet 2 of semi-rigid plastic material having a substantially rectangular shape and a sheet 3 of flexible plastic material having a substantially rectangular shape (shown only in FIG. 1), which is superimposed and welded to the sheet 2 of semi-rigid plastic material to define a sealed pocket 4 that contains a dose of a fluid product 5 (preferably in powder or granules).

In the embodiment shown in the attached figures, the sheet 2 of semi-rigid plastic material (and therefore the sealed package 1) has a rectangular shape having two larger sides parallel and opposite to each other and two smaller sides parallel and opposite to each other and perpendicular to the larger sides.

The sheet 2 of semi-rigid plastic material has at one end a pre-weakened area 6 (visible in FIGS. 2 and 3), which is formed at one end of the sheet 2 of semi-rigid plastic material (in particular at an edge, namely at a corner) and extends from an outer edge 7 of the sheet 2 of semi-rigid plastic material to an outer edge 8 of the sheet 2 of semi-rigid plastic material to divide the sheet 2 of semi-rigid plastic material into a holding portion (having an approximately trapezoidal shape) and a folding portion (having a triangular shape), which is smaller than the holding portion.

In the embodiment shown in the attached figures, the pre-weakened area 6 is arranged at a single edge (or a single corner) of the sheet 2 of semi-rigid plastic material and gives the folding portion a triangular shape. In the embodiment shown in the attached figures, the pre-weakened area 6 extends obliquely, thus forming an acute/obtuse angle both with the smaller sides of the sheet 2 of semi-rigid plastic material and with the larger sides of the sheet 2 of semi-rigid plastic material. In the embodiment shown in the attached figures, the pre-weakened area 6 extends from the outer edge 7 of the sheet 2 of semi-rigid plastic material, at a larger side, to the outer edge 8 of the sheet 2 of semi-rigid plastic material, at a smaller side.

Figure 8:
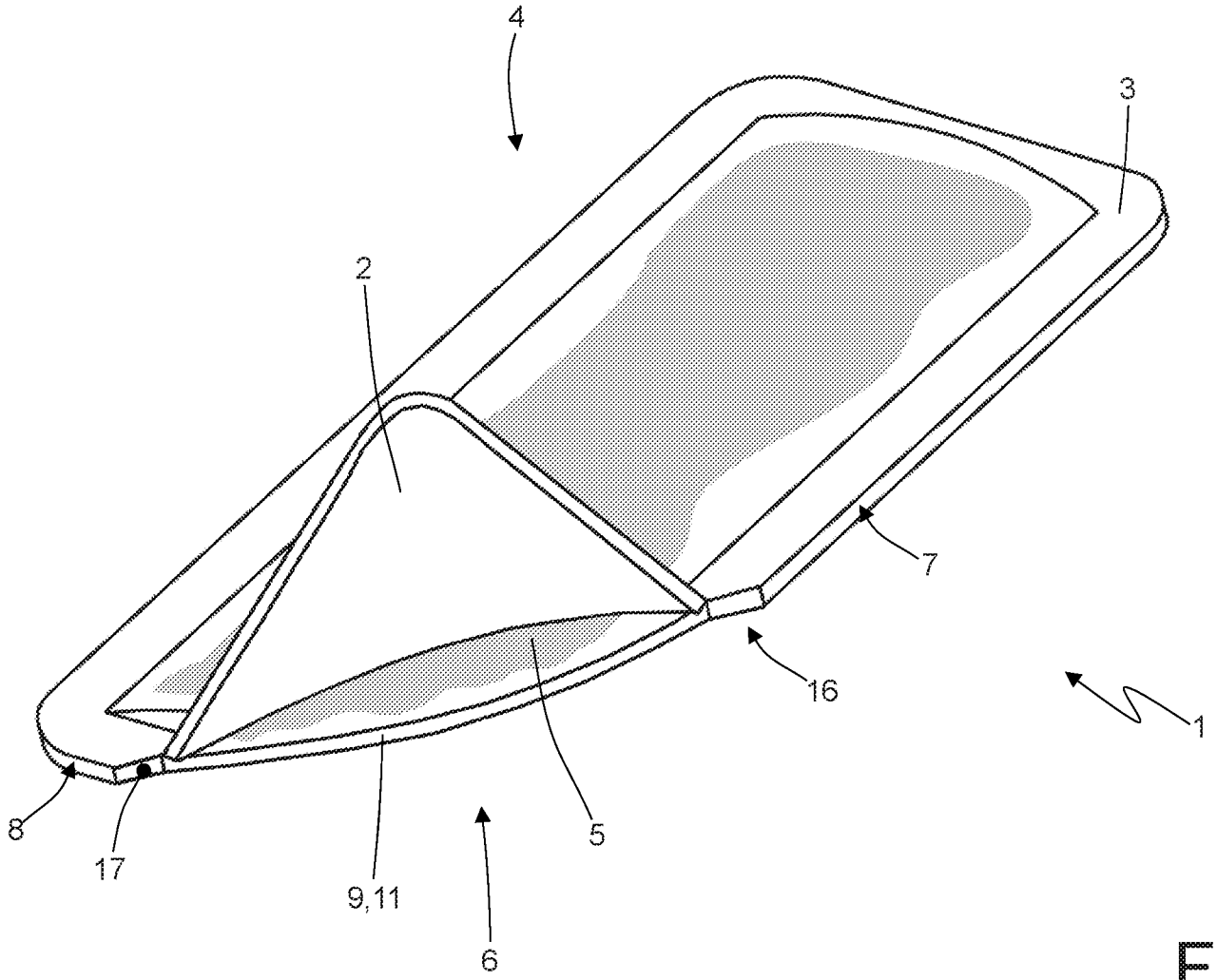
FIG. 8 is a perspective view of the sealed package of FIG. 1 during the opening of the sealed package.

In use, the pre-weakened area 6 guides a controlled break of the sheet 2 of semi-rigid plastic material to form through the sheet 2 of semi-rigid plastic material an outlet opening for the product 5 (shown in FIG. 8). In other words, in use, for opening the single-dose sealed package 1 a user must grasp the graspable portion of the sealed package 1 with the fingers of one hand and (typically with the fingers of the same hand) fold at (approximately) 180° the folding portion (i.e. the end delimited by the pre-weakened area 6) until the sheet 2 of semi-rigid plastic material breaks at the pre-weakened area 6. The break of the sheet 2 of semi-rigid plastic material at the pre-weakened area 6 forms the outlet opening (shown in FIG. 8) through which the product 5 (preferably in powder or granules) can leave the single-dose sealed package 1 in a simple and hygienic way.

According to alternative embodiments, the user must fold the folding portion (i.e. the end delimited by the pre-weakened area 6) at about 180° with respect to the portion that can be grasped only once and in only one direction (as shown in FIG. 8), or the user must fold the folding portion (i.e. the end delimited by the pre-weakened area 6) at 180° with respect to the portion that can be grasped twice and in the opposite direction (i.e. once to the right and immediately after to the left).

Figure 4:
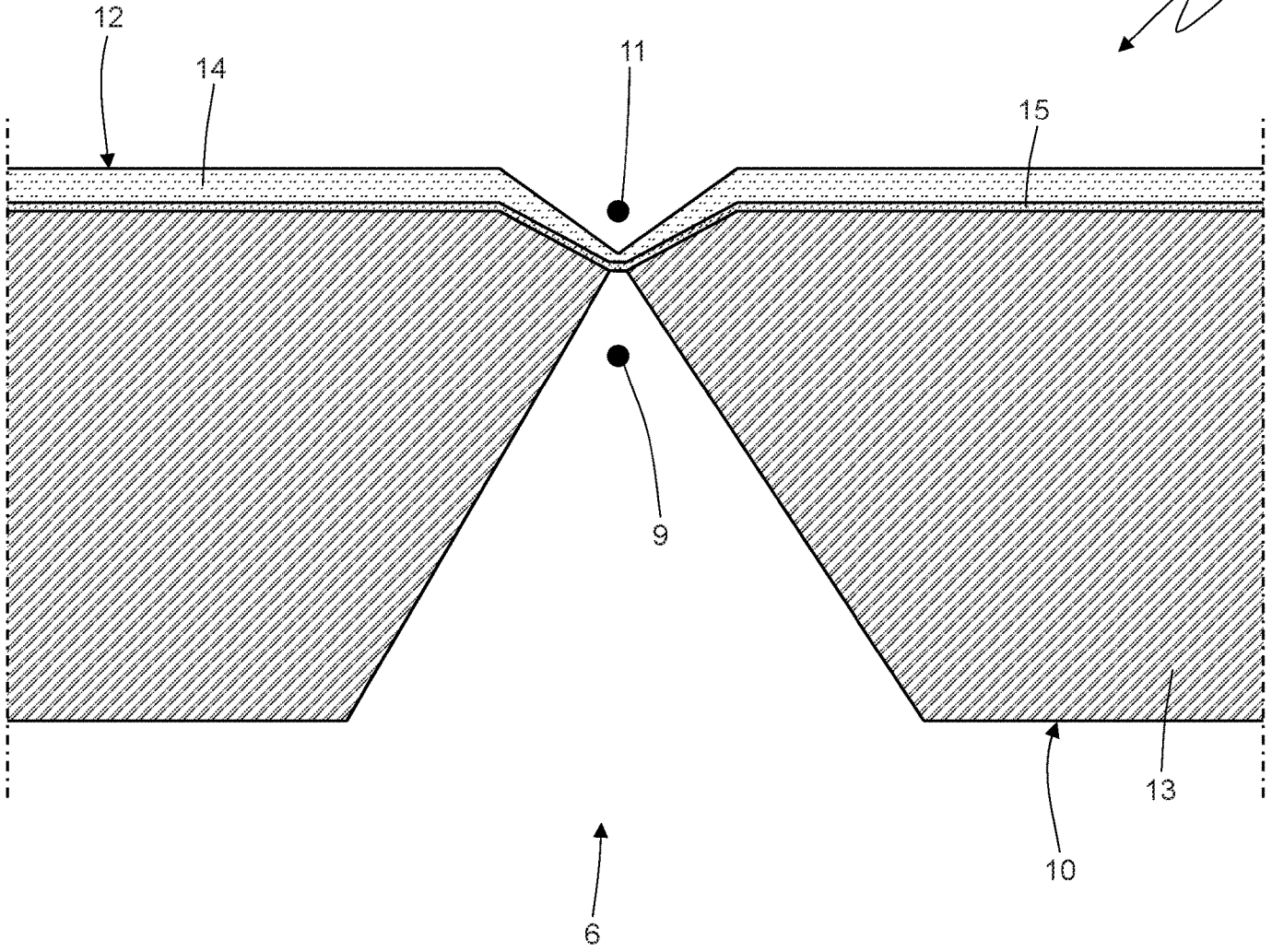
FIG. 4 is a sectional view along the section line IV-IV of a sheet of semi-rigid plastic material of the sealed package of FIG. 1.

As shown in FIGS. 3 and 4, the pre-weakened area 6 comprises an outer incision 9, which is formed through an outer surface 10 (i.e. opposite the pocket 4) of the sheet of semi-rigid plastic material. The outer incision 9 extends at least to the pocket 4 (i.e. the outer incision 9 is superimposed on the pocket 4).

Moreover, the pre-weakened area 6 comprises an inner incision 11, which is parallel and aligned with the outer incision 9, and is formed through an inner surface 12 (i.e. facing the pocket 4) of the sheet 2 of semi-rigid plastic material opposite the outer surface 10. The inner incision 11 is perfectly aligned (namely superimposed) with the outer incision 9 and extends only to the pocket 4 (i.e. the inner incision 11 is completely superimposed on the pocket 4) and only at the outer incision 9 (i.e. the inner incision 11 is entirely superimposed on the outer incision 9). In other words, the inner incision 11 extends only to the area housing the pocket 4 (on the side of the inner surface 12 of the sheet 2 of semi-rigid plastic material) and the outer incision 9 (on the side of the outer surface 10 of the sheet 2 of semi-rigid plastic material).

Figure 5:
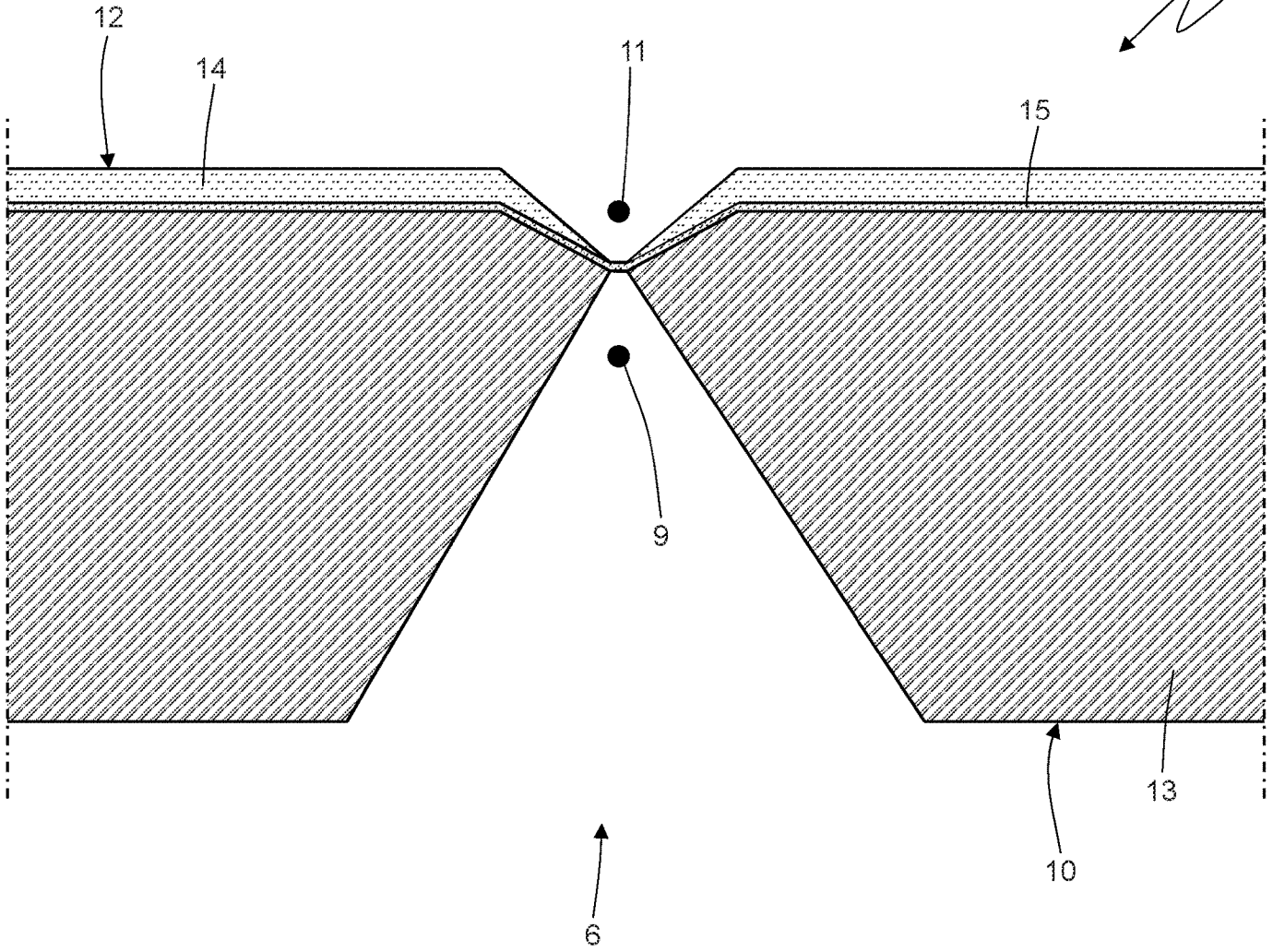
FIGS. 5 and 6 are two sectional views along the section line IV-IV of respective alternate embodiments of the sheet of semi-rigid plastic material.
Figure 6:
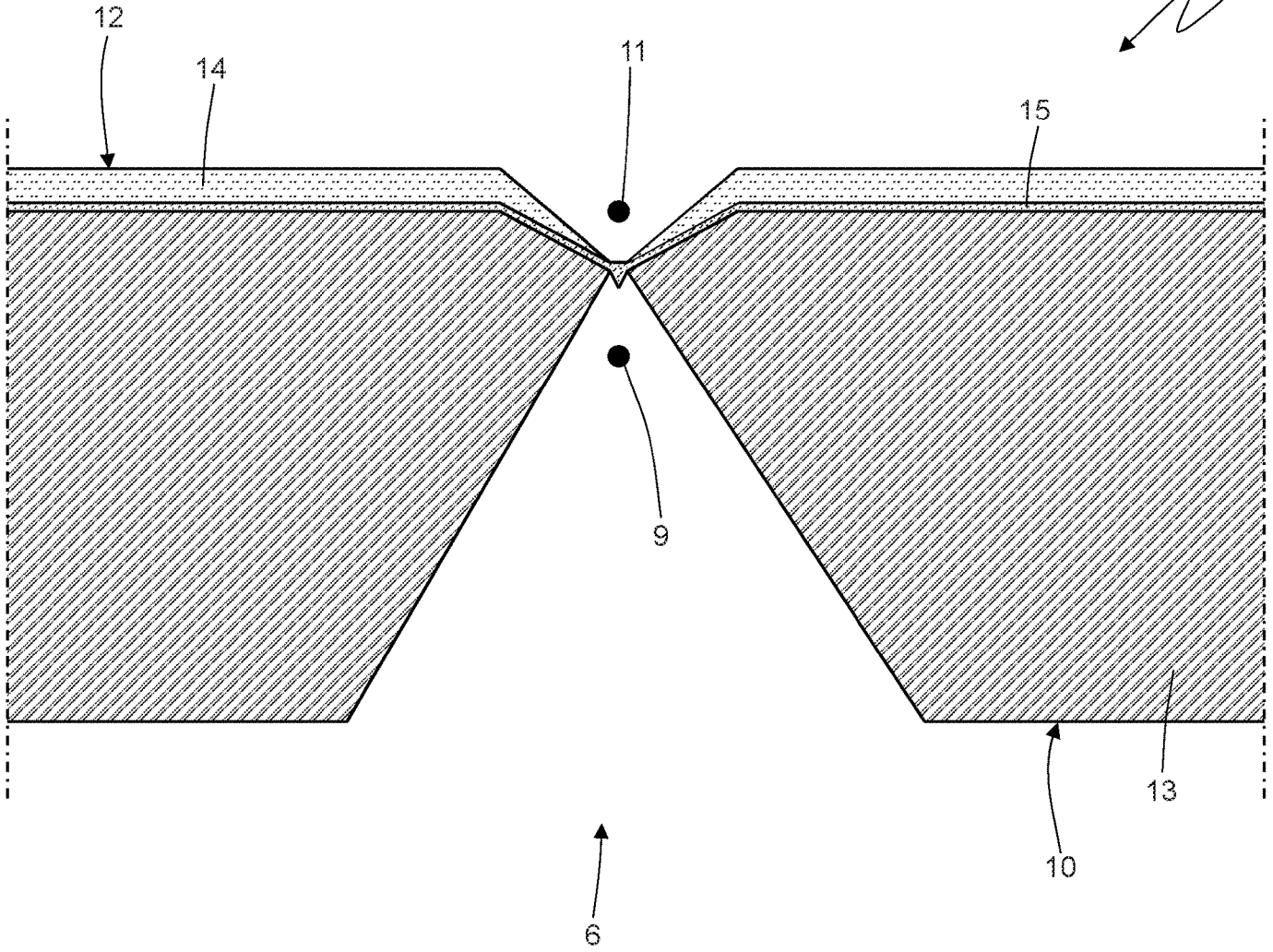

According to the embodiment shown in FIGS. 4, 5 and 6, the sheet 2 of semi-rigid plastic material consists of a laminate comprising an externally arranged supporting layer 13 (i.e. arranged on the side opposite the pocket 4 and at the outer surface 10) and an internally arranged heat-sealable layer 14 (i.e. arranged on the same side as the pocket 4, at the inner surface 12 and in contact with the sheet 3 of flexible plastic material). Between the supporting layer 13 and the heat-sealable layer 14 it is provided an insulating layer or barrier layer 15 that guarantees impermeability to air and/or light. By way of non-limiting example, the sheet 2 of semi-rigid plastic material could be composed of a supporting layer 13 of white polystyrene (PS) having a thickness of 400 microns (±10%), of a barrier layer 15 made of "Evoh" or of aluminium having a thickness of 10 microns (±10%) and of a heat-sealable layer 14 of polyethylene (PE) having a thickness of 45 microns (±10%).

The outer incision 9 is formed through the outer surface 10 of the sheet 2 of semi-rigid plastic material, has a "V" shape (but could also have a different shape) and is made by deforming and/or locally cutting the sheet 2 of semi-rigid plastic material. In particular, the outer incision 9 is made by deforming only the supporting layer 13 of the sheet 2 of semi-rigid plastic material. This means that the outer incision 9 affects only the supporting layer 13 of the sheet 2 of semi-rigid plastic material.

The inner incision 11 is formed through the inner surface 12 of the sheet 2 of semi-rigid plastic material, has a "V" shape (but could also have a different shape) and is made by deforming and/or locally cutting the sheet 2 of semi-rigid plastic material. In particular, the inner incision 11 is made by deforming all three layers, namely the supporting layer 13, the heat-sealable layer 14 and the barrier layer 15 of the sheet 2 of semi-rigid plastic material. This means that the inner incision 11 affects all three layers, namely the supporting layer 13, the heat-sealable layer 14 and the barrier layer 15 of the sheet 2 of semi-rigid plastic material.

The inner incision 11 is partially superimposed on the outer incision 9, namely the end of the inner incision 11 overlaps the end (and therefore "enters" the end) of the outer incision 9. In this partial overlapping of the inner incision 11 and of the outer incision 9, the heat-sealable layer 14 and above all the barrier layer 15 of the sheet 2 of semi-rigid plastic material are pushed (plastically deforming) into the outer incision 9, namely partially penetrate (enter) the end of the outer incision 9. In the embodiment shown in FIG. 4, both the heat-sealable layer 14 and the barrier layer 15 of the sheet 2 of semi-rigid plastic material partially penetrate (enter) the end of the outer incision 9, whereas in the equivalent embodiment shown in FIG. 5, only the barrier layer 15 of the sheet 2 of semi-rigid plastic material partially penetrates (enters) the end of the outer incision 9 (i.e. the heat-sealable layer 14 of the sheet 2 of semi-rigid plastic material tears near the end of the outer incision 9 and does not penetrate the end of the outer incision 9). In some situations and as shown in FIG. 6, it is also possible for a certain "build-up" of the barrier layer 15 to occur at the end of the inner incision 11 (i.e. at the end of the outer incision 9).

In other words, between a bottom of the outer incision 9 and a bottom of the inner incision 11, the barrier layer 15 is always present, the heat-sealable layer 14 may possibly be present, but the supporting layer 13 is never present (it is actually absent). Consequently, the supporting layer 13 has an interruption (i.e. it is interrupted, is absent) at the bottom of the outer incision 9 and, consequently, also at the bottom of the inner incision 11.

Please note that at the inner incision 11, the barrier layer 15 of the sheet 2 of semi-rigid plastic material is locally plastically deformed (even in an irregular way), but it is not torn, i.e. maintains its integrity. The substantial integrity of the barrier layer 15 of the sheet 2 of semi-rigid plastic material (even at the inner incision 11 made through the inner surface 12 of the sheet 2 of semi-rigid plastic material) ensures the perfect insulation of the pocket 4, which is therefore also suitable to contain perishable products and/or controlled bacterial loads such as food, medicines or cosmetics. Obviously, during the break-open of the single-dose sealed package 1 (obtained by folding the single-dose sealed package 1 along the pre-weakened area 6) it is necessary to break all three layers, namely the supporting layer 13, the heat-sealable layer 14 and the barrier layer 15 of the sheet 2 of semi-rigid plastic material at the pre-weakened area 6.

As previously stated, the inner incision 11 extends only to the area in which the pocket 4 is arranged and therefore at the inner incision 11 there are no welds between the sheet 2 of semi-rigid plastic material and the sheet 3 of flexible plastic material. It follows that any local tearing of the heat-sealable layer 14 of the sheet 2 of semi-rigid plastic material at the inner incision 11 has no negative consequence whatsoever.

The production process used to make the outer incision 9 and the inner incision 11 in the sheet 2 of semi-rigid plastic material is described e.g. in the Italian patent application 102018000001307 incorporated herein by reference.

Figure 7:
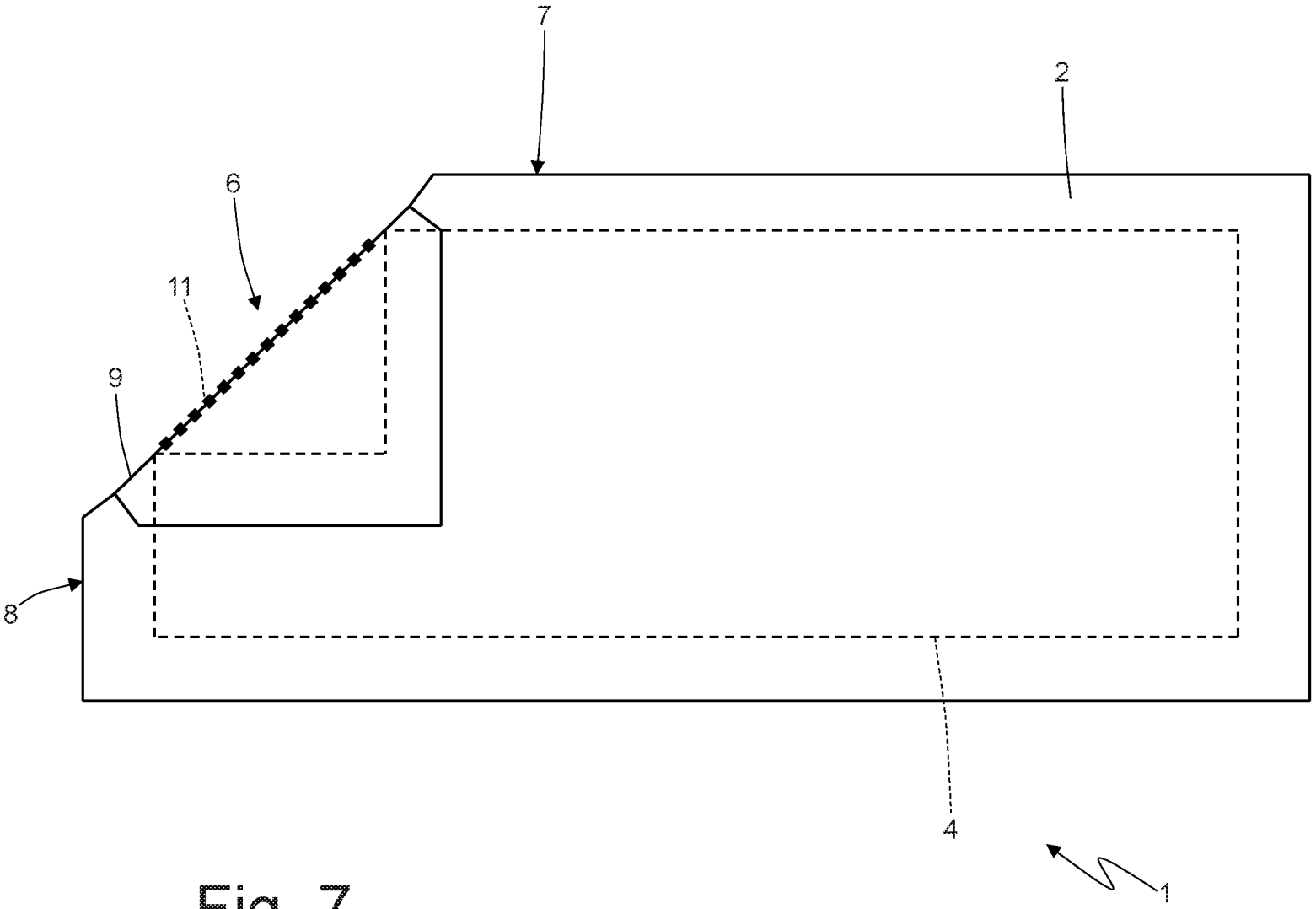
FIG. 7 is a bottom view of the sealed package of FIG. 1 during the opening of the sealed package.

As shown in FIG. 3, the outer incision 9 has a greater extension than the inner incision 11 and extends even outside the pocket 4, i.e. where the inner incision 11 is present also the outer incision 9 is present, but not the other way around. In fact, when the single-dose sealed package 1 is folded as shown in FIGS. 7 and 8, the outer incision 9 (in the portion superimposed on the inner incision 11) and the inner incision 11 cause a controlled break of the sheet 2 of semi-rigid plastic material to allow the release of the product 5 contained in the pocket 4. Moreover, the outer incision 9 (also in the portion not superimposed on the inner incision 11) guides the folding of the sheet 2 of semi-rigid plastic material so that the folding line of the sheet 2 of semi-rigid plastic material coincides with the incisions 9 and 11.

In the embodiment shown in FIGS. 1-9, the pre-weakened area 6 comprising the two incisions 9 and 11 is made at a single edge (namely at a single corner) of the sheet 2 of semi-rigid plastic material and extends obliquely (i.e. forming an acute/obtuse angle both with the smaller sides of the sheet 2 of semi-rigid plastic material and with the larger sides of the sheet 2 of semi-rigid plastic material). According to an alternative embodiment shown in FIGS. 10 and 11, the pre-weakened area 6 comprising the two incisions 9 and 11 is made at a whole end of the sheet 2 of semi-rigid plastic material (thus affecting the two edges of the same end) and extends obliquely (i.e. parallel to the smaller sides of the sheet 2 of semi-rigid plastic material and perpendicular to the larger sides of the sheet 2 of semi-rigid plastic material). Also in the embodiment shown in FIGS. 10 and 11, the (rectangular) folding portion is smaller than the (rectangular) holding portion; in particular, an area of the (rectangular) folding portion is comprised between 25% and 40% of an area of the (rectangular) holding portion.

In the embodiment shown in FIGS. 1-8 and 10 (e.g. in FIG. 3), the pre-weakened area 6 comprises two starting weakening elements 16, which are formed in the sheet 2 of semi-rigid plastic material and also in the sheet 3 of flexible plastic material, are aligned with the outer incision 9, are arranged on opposite sides of the outer incision 9 and determine a localized weakening of the sheet 2 of semi-rigid plastic material and of the sheet 3 of flexible plastic material. Following a folding of the package 1, the localized weakening facilitates the folding of the sheet 2 of semi-rigid plastic material and of the sheet 3 of flexible plastic material aligned with the outer incision 9 without at the same time causing any break of the sheet 2 of semi-rigid plastic material. In other words, the function of the starting weakening elements 16 is to make the sheet 2 of semi-rigid plastic material and the sheet 3 of flexible plastic material fold more easily at the outer incision 9 when the sealed package 1 is folded. Moreover, the starting weakening elements 16 do not cause any break of the sheet 2 of semi-rigid plastic material during the folding of the sealed package 1, since their function is only to guide the folding of the sealed package 1 without forming an outlet opening for the product 5 (the outlet opening for the product 5 is formed only at the incisions 9 and 11).

In the embodiment shown in the attached figures, the two starting weakening elements 16 are formed both in the sheet 2 of semi-rigid plastic material and in the sheet 3 of flexible plastic material. According to a different embodiment not shown, the two starting weakening elements 16 are formed only in the sheet 2 of semi-rigid plastic material (i.e. they do not affect the sheet 3 of flexible plastic material).

In the embodiment shown in the attached figures, each starting weakening elements 16 comprises a through cut 17, which is arranged at an outer edge 7 or 8 of the sheet 2 of semi-rigid plastic material and affects (passes through) both the sheet 2 of semi-rigid plastic material and the sheet 3 of flexible plastic material. Naturally, each through cut 17 is arranged outside the sealed pocket 4 (and at a safety distance from the sealed pocket 4) to avoid any undesired damage to the sealed pocket 4. Preferably, each through cut 17 has in plan view a triangular shape (equilateral) having a vertex from which the outer incision 9 originates and a base coinciding with an outer edge 7 or 8 of the sheet 2 of semi-rigid plastic material. Alternatively, each through cut 17 could have a rectangular shape. Moreover, preferably each through cut 17 has a depth comprised between 1 and 4 mm.

Figure 9:
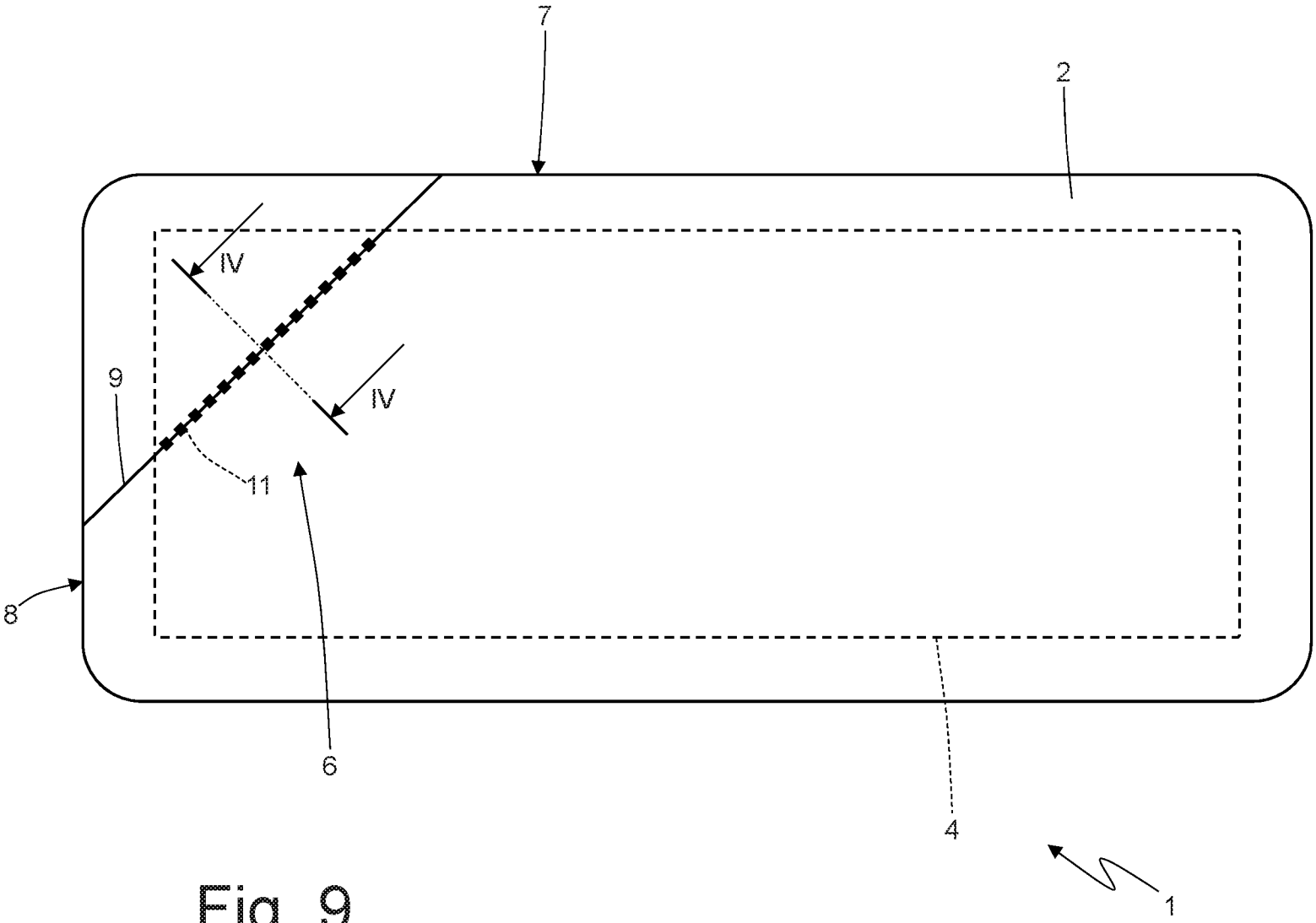
FIGS. 9, 10 and 11 are three bottom views of respective variants of the sealed package of FIG. 1.
Figure 10:
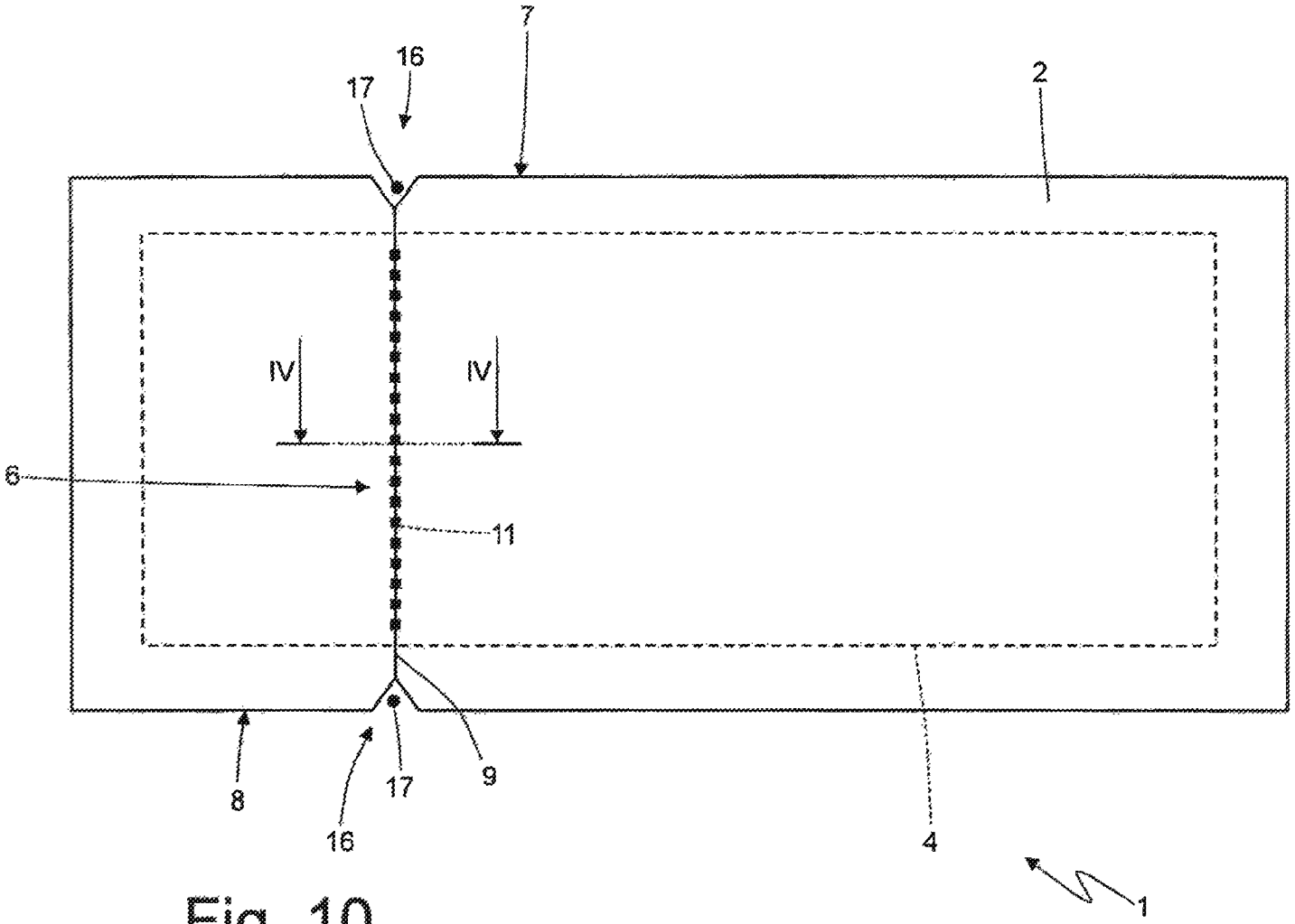
Figure 11:
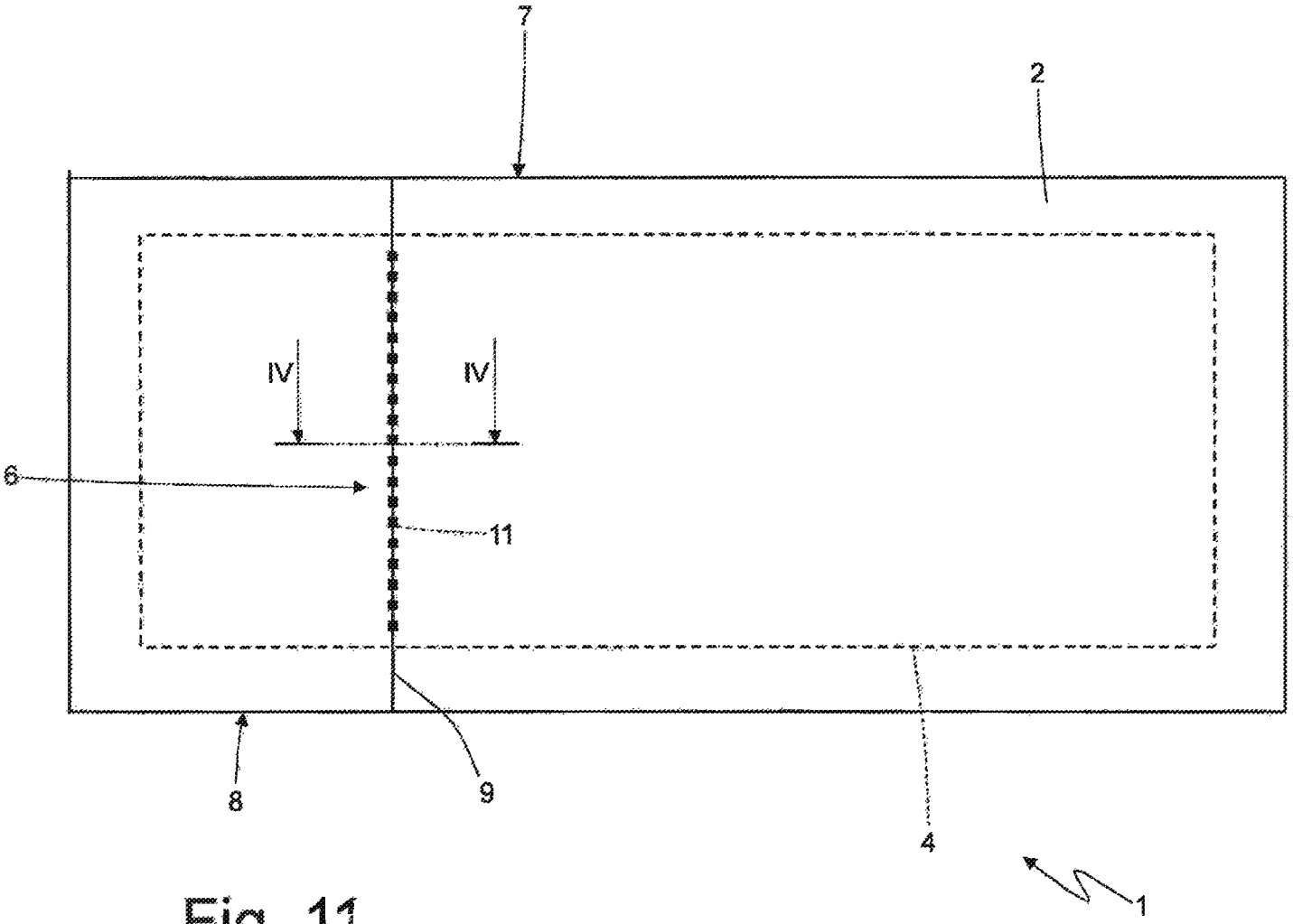

According to a different embodiment shown in FIGS. 9 and 11, the pre-weakened area 6 lacks the two starting weakening elements 16.

In the embodiment shown in the attached figures, the incisions 9 and 11 are continuous, i.e. without interruptions. According to an alternative and perfectly equivalent embodiment not shown, the incisions 9 and 11 can be discontinuous, namely they can have one or more interruptions (which, in this case, can be defined as two discontinuous incisions 9 and 11 or as a series of aligned and spaced apart incisions 9 and 11).

The inner incision 11 could have a variable depth along its length; this feature is preferable (but not strictly necessary) to improve the opening of the single-dose sealed package 1 when the single-dose sealed package is folded into a "V" shape. In other words, the fact that the inner incision 11 has a variable depth along its length allows obtaining a progressive break of the sheet 2 of semi-rigid plastic material when the single-dose sealed package 1 is folded. Analogously, the outer incision 9 could also have a variable depth along its length. In other words, both incisions 9 and 11 could have a variable depth along their length, only one of the two incisions 9 and 11 could have a variable depth along its length or both incisions 9 and 11 could have a constant depth along their length.

In the embodiment shown in the attached figures, the single-dose sealed package 1 has a rectangular shape. Obviously, for aesthetic reasons the single-dose sealed package could have any other shape: round, elliptical, bottle-shaped, rhomboid, pentagonal, hexagonal, triangular, square, bone-shaped. Obviously, the outer surface 10 of the sheet 2 of semi-rigid plastic material and/or the outer surface of the sheet 3 of flexible plastic material can be printed both to report information on the product 5 and to be an aesthetic ornament.

In the embodiment shown in the attached figures, the sealed package 1 is single-dose (i.e. it contains a single dose of the product 5). According to other embodiments not shown, the sealed package 1 contains several doses of the product 5, which are extracted from the sealed package 1 at different times. By folding the sealed package 1, the product 5 can leave the sealed package 1 through a break of the sheet 2 of semi-rigid plastic material, whereas by making the sealed package 1 "flat" again, the break of the sheet 2 of semi-rigid plastic material is recomposed, thus substantially preventing any further leakage of the product 5.

The embodiments described herein can be combined with each other without departing from the scope of protection of the present invention.

The single-dose sealed package 1 described above has several advantages.

First, the sealed package 1 described above allows the simple and effective dosing of powdered or granulated products, since the passage section through the controlled break of the sheet 2 of semi-rigid plastic material is adequately extended and wide to allow an optimal (complete) release of a powdered or granulated product.

Moreover, the sealed package 1 described above is simple and inexpensive to produce since its manufacture is completely analogous to the manufacture of a similar standard sealed package (e.g. of the type described in the patent application WO2009040629A2). In fact, the differences are concentrated in the shape of the pre-weakened area 6, therefore in the shape of the tools that make the pre-weakened area 6. In other words, the sealed package 1 described above can be manufactured in an existing packaging machine that produces standard sealed packages simply by adapting only the engraving unit.

LIST OF REFERENCE NUMBERS IN THE FIGURES

1 package
2 semi-rigid sheet
3 flexible sheet
4 pocket
5 product
6 pre-weakened area
7 outer edge
8 outer edge
9 outer incision
10 outer surface
11 inner incision
12 inner surface
13 supporting layer
14 heat-sealable layer
15 barrier layer
16 starting weakening elements
17 through cut

The invention claimed is:

1. A break-open sealed package comprising:

a first sheet of semi-rigid plastic material;

a sealed pocket, which contains a dose of a product and is delimited on one side by the first sheet; and a pre-weakened area, which guides, following a folding of the first sheet, a controlled break of the first sheet in the pre-weakened area to form an outlet opening for the product through the first sheet;

wherein the pre-weakened area comprises an outer incision, which is formed through an outer surface of the first sheet and at least partially extends to an area of the pocket, and an inner incision, which is parallel to and aligned with the outer incision and is formed through an inner surface of the first sheet, which is opposite the outer surface;

wherein the pre-weakened area is arranged at an end of the first sheet and extends from a first outer edge of the first sheet to a second outer edge of the first sheet to divide the first sheet into a holding portion and into a folding portion that is smaller than the holding portion;

wherein the first sheet is made up of a laminate comprising: a supporting layer arranged on the outside, a heat-sealable layer arranged on the inside and a barrier layer interposed between the supporting layer and the heat-sealable layer; and wherein the barrier layer of the first sheet is partially arranged inside the outer incision.

2. A sealed package according to claim 1, wherein the pre-weakened area is arranged at a single corner of the first sheet and gives the folding portion a triangular shape.

3. A sealed package according to claim 2, wherein:

the first sheet has a rectangular shape having two larger sides and two smaller sides; and the pre-weakened area is arranged obliquely relative to the first sheet, thus forming an acute/obtuse angle both with the smaller sides of the first sheet and with the larger sides of the first sheet.

4. A sealed package according to claim 3, wherein the pre-weakened area extends from the first outer edge of the first sheet at a larger side to the second outer edge of the first sheet at a smaller side.

5. A sealed package according to claim 1, wherein the pre-weakened area is arranged at two edges of the first sheet and gives the folding portion a rectangular shape.

6. A sealed package according to claim 5, wherein:

the first sheet has a rectangular shape having two larger sides and two smaller sides; and the pre-weakened area extends parallel to the smaller sides of the first sheet and perpendicular to the larger sides of the first sheet.

7. A sealed package according to claim 5, wherein an area of the rectangular folding portion is between 25% and 40% of an area of the rectangular holding portion.

8. A sealed package according to claim 1, wherein:

the outer incision extends from the first outer edge of the first sheet to the second outer edge of the first sheet; and the inner incision extends only in the area of the pocket and ends at a distance other than zero from the outer edges of the first sheet.

9. A sealed package according to claim 1, wherein the pre-weakened area comprises two starting weakening elements, which are formed in the first sheet at the first outer edge and at the second outer edge, are arranged on opposite sides of the outer incision and determine a local weakening of the first sheet, which facilitates the folding of the first sheet.

10. A sealed package according to claim 9, wherein each starting weakening element comprises a through cut, which is arranged outside the sealed pocket; and each through cut has, in plan view, a triangular shape having a vertex from which the outer incision originates and a base coinciding with an outer edge of the first sheet.

11. A sealed package according to claim 1, wherein between a bottom of the outer incision and a bottom of the inner incision there is at least the barrier layer and there is no supporting layer as the supporting layer has an interruption at the bottom of the outer incision.

12. A sealed package according to claim 11, wherein between the bottom of the outer incision and the bottom of the inner incision, besides the barrier layer, there is also the heat-sealable layer and there is no supporting layer.

13. A sealed package according to claim 12, wherein:

the outer incision extends only in the supporting layer of the first sheet; and the inner incision affects the supporting layer, the heat-sealable layer and the barrier layer, of the first sheet.

14. A sealed package according to claim 1, wherein there is a build-up of the barrier layer at a bottom of the outer incision.

15. A break-open sealed package comprising:

a first sheet of semi-rigid plastic material;

a sealed pocket, which contains a dose of a product and is delimited on one side by the first sheet; and a pre-weakened area, which guides, following a folding of the first sheet, a controlled break of the first sheet in the pre-weakened area to form an outlet opening for the product through the first sheet;

wherein the pre-weakened area comprises an outer incision, which is formed through an outer surface of the first sheet and at least partially extends to an area of the pocket, and an inner incision, which is parallel to and aligned with the outer incision and is formed through an inner surface of the first sheet, which is opposite the outer surface;

wherein the pre-weakened area is arranged at an end of the first sheet and extends from a first outer edge of the first sheet to a second outer edge of the first sheet to divide the first sheet into a holding portion and into a folding portion that is smaller than the holding portion;

wherein the first sheet is made up of a laminate comprising: a supporting layer arranged on the outside, a heat-sealable layer arranged on the inside and a barrier layer interposed between the supporting layer and the heat-sealable layer; and wherein there is a build-up of the barrier layer at a bottom of the outer incision.

* * * * *